US010661571B2

(12) United States Patent
Mueller et al.

(10) Patent No.: US 10,661,571 B2
(45) Date of Patent: May 26, 2020

(54) PRINT BAR FOR INKJET PRINTING HAVING GUIDE PROFILES FOR GUIDING HEAD MOUNTS FOR PRINT HEADS

(71) Applicant: HEIDELBERGER DRUCKMASCHINEN AG, Heidelberg (DE)

(72) Inventors: Andreas Mueller, Heidelberg (DE); Burkhard Wolf, Dossenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 16/273,196

(22) Filed: Feb. 12, 2019

(65) Prior Publication Data

US 2019/0248145 A1 Aug. 15, 2019

(30) Foreign Application Priority Data

Feb. 12, 2018 (DE) ..... 10 2018 202 100

(51) Int. Cl.

*B41J 2/175* (2006.01)
*B41J 25/34* (2006.01)
*B41J 25/00* (2006.01)

(52) U.S. Cl.

CPC ..... *B41J 2/1752* (2013.01); *B41J 25/34* (2013.01); *B41J 2025/008* (2013.01); *B41J 2202/20* (2013.01); *B41J 2202/21* (2013.01)

(58) Field of Classification Search

CPC ..... B41J 2/1752; B41J 25/34; B41J 2202/20; B41J 2202/21; B41J 2025/008; B41J 2202/19; B41J 2/145; B41J 2/155

See application file for complete search history.

(56) References Cited

U.S. PATENT DOCUMENTS

| | | | | |
|---|---|---|---|---|
| 6,283,651 | B1 * | 9/2001 | Holmberg | B41J 25/006 347/8 |
| 6,585,347 | B1 * | 7/2003 | Johnson | B41J 2/16517 347/22 |
| 7,798,606 | B2 | 9/2010 | Nishino | |
| 8,215,605 | B1 * | 7/2012 | Shepley | A01K 63/006 224/562 |
| 9,358,818 | B2 * | 6/2016 | Von Essen | B41J 25/34 |
| 9,566,810 | B2 | 2/2017 | Von Essen et al. | |
| 2002/0024554 | A1 | 2/2002 | Tominaga | |
| 2016/0303856 | A1 * | 10/2016 | Coma Vives | B41J 2/1433 |
| 2017/0217231 | A1 | 8/2017 | Von Essen et al. | |

FOREIGN PATENT DOCUMENTS

| | | | |
|---|---|---|---|
| EP | 0992348 | B1 | 12/2004 |
| WO | 2014160219 | A1 | 10/2014 |

* cited by examiner

*Primary Examiner* — Henok D Legesse
(74) *Attorney, Agent, or Firm* — Laurence A. Greenberg; Werner H. Stemer; Ralph E. Locher

(57) ABSTRACT

A print bar for inkjet printing includes a crossbar carrier, a row of head mounts carried by the crossbar carrier, and print heads held by the head mounts. Every head mount has lateral guide profiles for linearly guiding the head mounts. The guide profiles of respective adjacent or neighboring head mounts engage in one another.

5 Claims, 2 Drawing Sheets

PRINT BAR FOR INKJET PRINTING HAVING GUIDE PROFILES FOR GUIDING HEAD MOUNTS FOR PRINT HEADS

CROSS-REFERENCE TO RELATED APPLICATION

This application claims the priority, under 35 U.S.C. § 119, of German Patent Application DE 10 2018 202 100.7, filed Feb. 12, 2018; the prior application is herewith incorporated by reference in its entirety.

BACKGROUND OF THE INVENTION

Field of the Invention

The present invention relates to a print bar for inkjet printing including a crossbar-type carrier, a row of head mounts carried by the crossbar carrier, and print heads mounted to the head mounts.

Such print bars are used in page-wide inkjet printing. The print heads are disposed in a row extending over the format width of the sheet or web.

International Publication WO 2014160219 A1, corresponding to U.S. Pat. Nos. 9,358,818 and 9,566,810 as well as U.S. Publication No. 2017/0217231, discloses a print bar that is manufactured in a complex process. A large number of components is required to fix the print heads to the crossbar carrier, resulting in a long tolerance chain of strict component tolerances. In addition, the components are delicate and require very careful adjustment.

SUMMARY OF THE INVENTION

It is accordingly an object of the invention to provide a print bar for inkjet printing, which overcomes the hereinafore-mentioned disadvantages of the heretofore-known devices of this general type and which is easy to manufacture and robust to handle.

With the foregoing and other objects in view there is provided, in accordance with the invention, a print bar for inkjet printing, comprising a crossbar carrier, a row of head mounts carried by the crossbar carrier, and print heads mounted to the head mounts. Each head mount has lateral guide profiles for linearly guiding the head mounts, and the guide profiles of respective neighboring or adjacent head mounts mesh or engage with one another.

Integrating the guide profiles directly into the head mounts reduces the number of components, reducing the length of the tolerance chains. The remaining component tolerances may be comparatively large. An additional advantage is that no complex adjustment of components within the head mount is required.

Various further developments are possible:

- Every head mount may have two guide profiles of different contours.
- One guide profile of a respective head mount may be a female profile and the other guide profile may be a male profile.
- The guide profiles may form T groove guides.
- At least one head mount may be held on the crossbar carrier by at least one retainer magnet. The retainer magnet's may be fixed to the crossbar carrier or, preferably, to the head mount's, for instance glued thereto.

Other features which are considered as characteristic for the invention are set forth in the appended claims.

Although the invention is illustrated and described herein as embodied in a print bar for inkjet printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
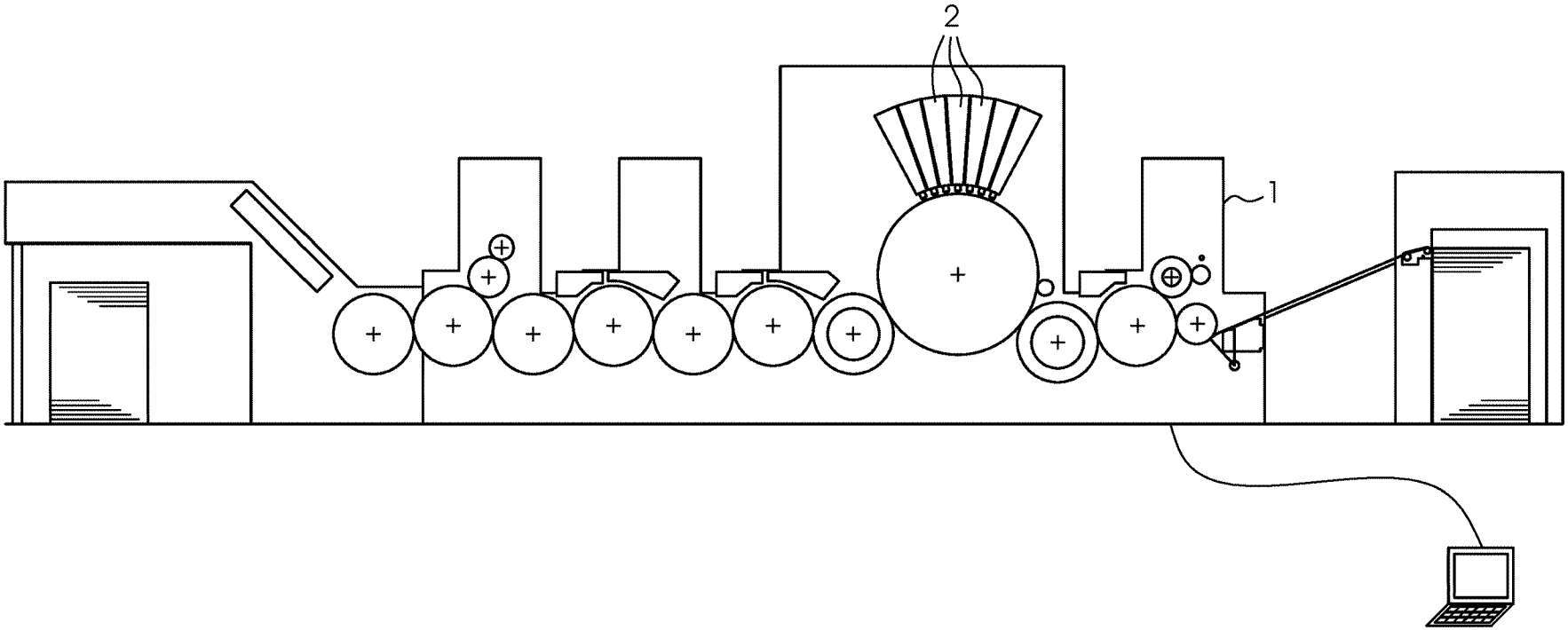
FIG. 1 is a diagrammatic, longitudinal-sectional side view of a printing machine including a print bar for inkjet printing.

Referring now to the figures of the drawings in detail and first, particularly, to FIG. 1 thereof, there is seen a printing machine 1 for printing on sheets in an inkjet printing process. The printing machine 1 includes a plurality of print bars 2, each one of which jets a different color. The print bars 2 are of identical construction. The following figures illustrate an example of a print bar 2.

Figure 2:
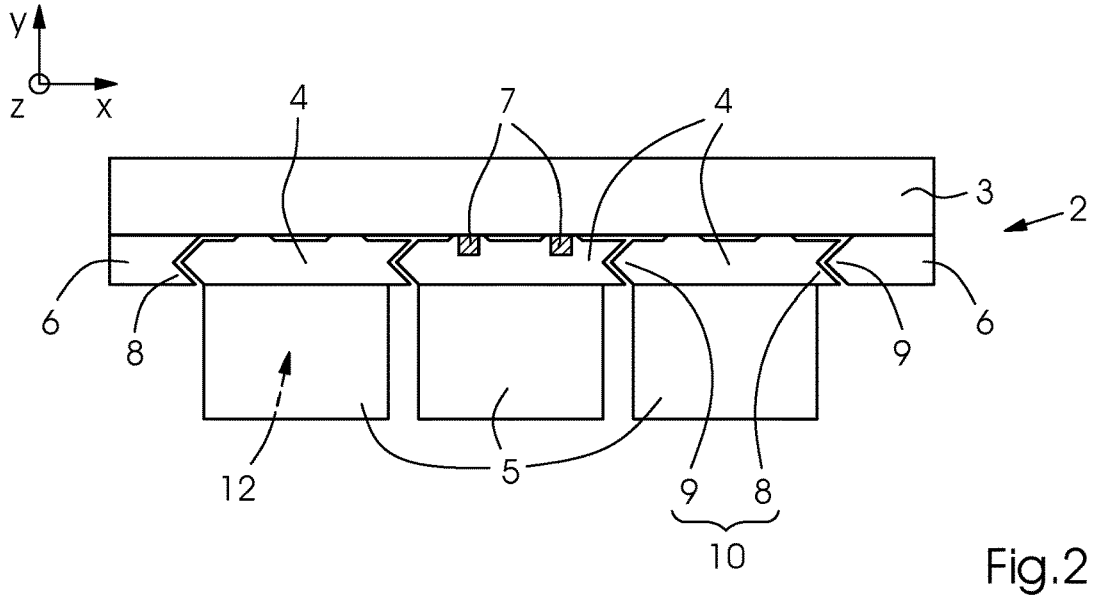
FIG. 2 is a partly-sectional, top-plan view of a first exemplary embodiment of the print bar including prism guides that interconnect head mounts.
Figure 3:
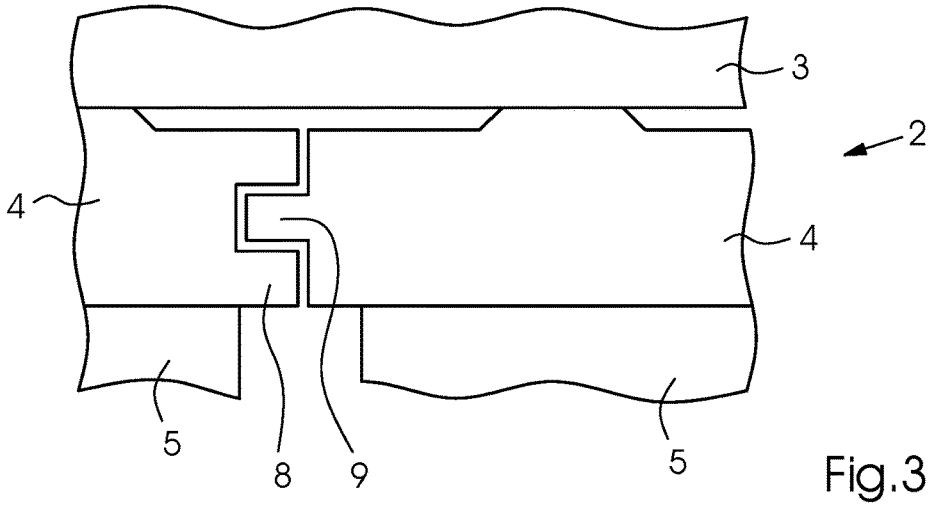
FIG. 3 is an enlarged, fragmentary, top-plan view of a second exemplary embodiment including groove-and-block guides that interconnect the head mounts.
Figure 4:
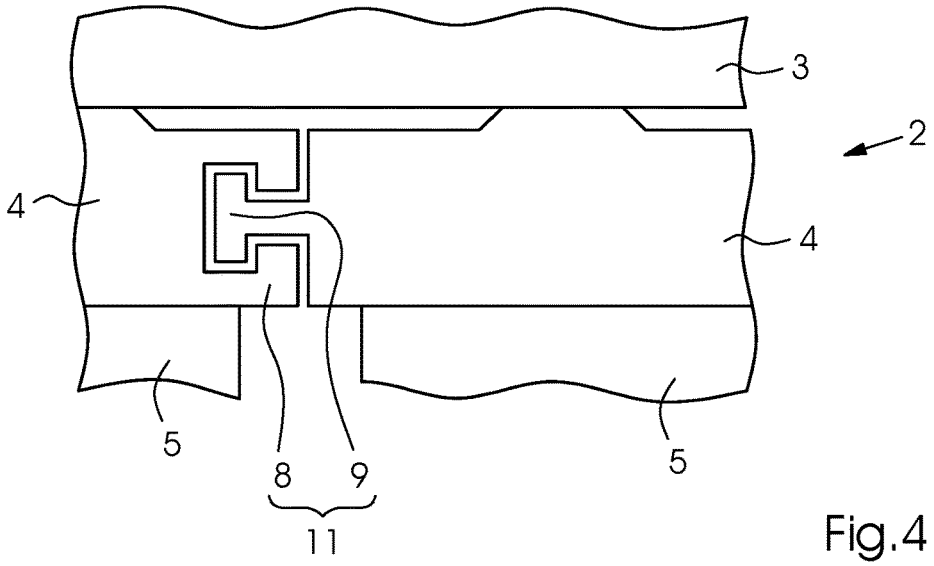
FIG. 4 is an enlarged, fragmentary, top-plan view of a third exemplary embodiment including T groove guides that interconnect the head mounts.

While FIG. 1 is a side view of the print bar 2, FIGS. 2 to 4 are top views of the print bar 2. FIGS. 3 and 4 are enlarged sectional views as compared to FIG. 2.

As is shown in FIG. 2, the print bar 2 has a crossbar carrier 3, which may be constructed as a rail or frame. The crossbar carrier 3 runs or has a longitudinal extent in a direction perpendicular to the direction of printing material transport, which is the vertical direction in FIGS. 2 to 4. With respect to FIG. 1 the longitudinal extent of the crossbar carrier 3 is perpendicular to the plane of the drawing.

An end piece 6 is disposed at the bar ends of the crossbar carrier 3. The end piece 6 may be formed on or fixed to, e.g. screwed to, the crossbar carrier 3. A row of head mounts 4 is disposed between the two end pieces 6. A print head 5 having a nozzle plate 12 is fixed to every head mount 4. Nozzles that terminate in the nozzle plate 12 and jet ink are not shown in any detail in the figure. The nozzle plates 12 are made of silicon and are very delicate. Therefore, the measures described below ensure that when the print bar 2 is mounted and adjusted, virtually any collision between the nozzle plates 12 is prevented. The print heads 5 are of identical construction. The head mounts 4 are likewise of identical construction, allowing every head mount 4 to be placed in every position along the row of head mounts 4 in the modular construction system provided herein. A retainer magnet 7 or, preferably, a plurality of retainer magnets 7 is attached to every head mount 4, for instance by being inserted in the back of the head mount 4. The retainer magnets 7 magnetically fix the head mount 4 to the crossbar carrier 3.

FIG. 2 provides a sectional view of the retainer magnets 7 of a sample head mount 4. Every head mount 4 has a respective guide profile 8, 9 on each of its ends facing the neighboring head mounts 4 and end pieces 6. One guide profile is a recessed or female guide profile 8 and the other guide profile is a protruding or male guide profile 9. Moreover, one end piece 6 has a female guide profile 8 and the other end piece 6 has a male guide profile 9. In the assembled state of the print bar 2, every male guide profile 9 engages with a female guide profile 8. Every pair of engaged guide profiles 8, 9 forms a linear guide for guiding the respective head mount 4 in a direction z. The orthogonal coordinate system added to FIG. 2 indicates that the z direction is perpendicular to directions x, y, which in turn are perpendicular to one another. The crossbar carrier 3, the row of head mounts 4, and the row of print heads 5 extend in a direction parallel to the x direction. The direction of printing material transport is parallel to the y direction. In FIG. 2, two respective guide profiles 8, 9 together form a prism guide 10. The male guide profile 9 has a cross section shaped like a pitched roof and the female guide profile 8 has a complementary shape. The retainer magnets 7 act as mounting aids, preventing the head mounts 4 from being dropped while being handled. Due to the retainer magnets 7, the guide profiles 8, 9 may be of simpler construction because the retainer magnets 7 fix the head mounts 4 in the y direction and in terms of a rotation about the axis defined by the z direction. When the print bar 3 is assembled, the head mounts 4 and the print heads 5, which have already been fixed thereto, are slid into one another in the z direction, causing the guide profiles 8, 9 to engage with one another. Then they guide the head mounts 4 as they are moved into the end positions thereof. Thus, during the movement, every head mount 4 is secured in all degrees of freedom except in the z direction.

The exemplary embodiment shown in FIG. 3 only differs from the one shown in FIG. 2 in terms of the cross-sectional shape of the guide profiles 8, 9. Every female guide profile 8 has a U-shaped cross-section. This includes a simple groove. The male guide profiles 9 have a quadrangular cross section, practically forming square rails that run in the groove of the female guide profiles 8 during a displacement.

In the exemplary embodiment shown in FIG. 4, every female guide profile 8 has a C-shaped cross section. This includes a T groove. The male guide profiles 9 are basically T-profile rails formed on the head mounts 4 and running in the T grooves of the neighboring head mounts 4 during a displacement. Every pair of guide profiles 8, 9 that have been inserted into one another forms a T groove guide 11. The T groove guides 11 are advantageous because their use allows the end pieces 6 to be dispensed with. Each one of the two head mounts 4 at the ends of the row of head mounts 4 is only fixed and held by a single T groove guide 11. In every other respect, the exemplary embodiment shown in FIG. 4 corresponds to the exemplary embodiment shown in FIG. 2.

The following is a summary list of reference numerals and the corresponding structure used in the above description of the invention:

1 printing machine
2 print bar
3 crossbar carrier
4 head mount
5 print head
6 end piece
7 retainer magnet
8 guide profile (female)
9 guide profile (male)
10 prism guide
11 T groove guide
12 nozzle plate
x, y, z direction

The invention claimed is:

1. A print bar for inkjet printing, the print bar comprising:
a crossbar carrier;
a row of head mounts carried by said crossbar carrier, said row of head mounts extending in a second direction; and
print heads held by said head mounts;
each of said head mounts having lateral guide profiles for linearly guiding said head mounts, said guide profiles of respective adjacent head mounts forming pairs of guide profiles engaging in one another; and
each of said pairs of guide profiles engaging in one another forming a linear guide guiding a respective head mount in a first direction being orthogonal to said second direction.

2. The print bar according to claim 1, wherein each of said head mounts has two respective guide profiles with different contours.

3. The print bar according to claim 2, wherein one of said guide profiles of each respective head mount is a female profile and another guide profile of each respective head mount is a male profile.

4. The print bar according to claim 1, wherein said guide profiles form T-shaped groove guides.

5. The print bar according to claim 1, which further comprises at least one retainer magnet fixing at least one of said head mounts to said crossbar carrier.

* * * * *